US005472316A

United States Patent [19]

Taslim et al.

[11] Patent Number: 5,472,316

[45] Date of Patent: Dec. 5, 1995

[54] ENHANCED COOLING APPARATUS FOR GAS TURBINE ENGINE AIRFOILS

[75] Inventors: Mohammad E. Taslim, Needham, Mass.; Samuel D. Spring, Stratham, N.H.; Thomas E. Demarche, Boxford, Mass.

[73] Assignee: General Electric Company, Cincinnati, Ohio

[21] Appl. No.: 308,227

[22] Filed: Sep. 19, 1994

[51] Int. Cl.[6] ..... F01D 5/18

[52] U.S. Cl. ..... 416/97 R; 416/96 R

[58] Field of Search ..... 416/96 R, 96 A, 416/97 R

[56] References Cited

U.S. PATENT DOCUMENTS

| | | | |
|---|---|---|---|
| 3,628,885 | 12/1971 | Sidenstick et al. | 416/96 R |
| 4,135,855 | 1/1979 | Peill . | |
| 4,474,532 | 10/1984 | Padzer . | |
| 4,514,144 | 4/1985 | Lee . | |
| 4,627,480 | 12/1986 | Lee . | |
| 5,073,086 | 12/1991 | Cooper . | |
| 5,120,192 | 6/1992 | Ohtomo et al. | 416/96 A |
| 5,232,343 | 8/1993 | Butts . | |
| 5,246,340 | 9/1993 | Winstanley et al. . | |
| 5,352,091 | 10/1994 | Sylvestro | 416/97 R |
| 5,387,086 | 2/1995 | Frey et al. | 416/96 R |

FOREIGN PATENT DOCUMENTS

| | | | |
|---|---|---|---|
| 0230917 | 8/1987 | European Pat. Off. | 416/97 R |
| 0085102 | 4/1987 | Japan | 416/96 R |
| 0126208 | 6/1987 | Japan | 416/96 R |
| 0066401 | 3/1989 | Japan | 416/96 R |

*Primary Examiner*—Edward K. Look
*Assistant Examiner*—Mark Sgantzos
*Attorney, Agent, or Firm*—Andrew C. Hess; David L. Narciso

[57] ABSTRACT

An improved cooling passage configuration for a gas turbine engine airfoil is disclosed for enhancing convective cooling over that afforded by conventional wall turbulator ribs. An internal cooling passage bounded by pressure and suction side walls and at least one partition has raised turbulator ribs disposed on at least one side wall and the partition. A side wall turbulator rib extends over at least a portion of the side wall and abuts the partition. A turbulator rib disposed on the partition extends from a point spaced from the wall rib to the opposed side wall. The gap formed between the partition rib and wall rib accelerates a coolant flow passing therethrough, locally enhancing convective heat transfer. Partition ribs may be aligned with or offset from the wall ribs in the spanwise direction and may be normal to the primary direction of cooling flow or angled thereto. Convective heat transfer is particularly enhanced in flow passages having cavity height blockage due to wall ribs greater than about 10%.

20 Claims, 4 Drawing Sheets

ENHANCED COOLING APPARATUS FOR GAS TURBINE ENGINE AIRFOILS

The U.S. Government has rights in this invention pursuant to Contract No. N00019-91-C-0114.

TECHNICAL FIELD

The present invention relates generally to cooling of airfoils subjected to hot primary flowpath gases in a gas turbine engine and more specifically to an improved cooling passage configuration in a turbine blade or vane airfoil.

BACKGROUND INFORMATION

Airfoil structures in modern gas turbine engines, including those forming portions of rotating turbine blades and stationary nozzle vanes, are subjected to extremely high temperatures due to impingement thereon of hot combustion gas flow. In order to maintain acceptable mechanical properties in this harsh environment, metal blades and vanes are routinely cooled internally by air bled from a compressor portion of the engine. Since cooling air is not available to be mixed with fuel, ignited in the combustor and undergo work extraction in the primary gas flowpath of the turbine, cooling flow is treated as a parasitic loss in the engine operating cycle, it being desirable to keep such losses to a minimum.

Various schemes are employed to enhance cooling of an airfoil with a predetermined flow rate of cooling air so as to maintain an acceptable airfoil temperature profile. Such schemes include creating one or more flow passages within the airfoil to direct the cooling flow in an advantageous manner, for example by first directing the cooling flow to the hottest portion of the airfoil such as a leading edge. Additionally, internal sides of airfoil pressure and suction walls are often provided with obstructive surface features such as turbulator ribs, strips or pins which extend into the flow passage. By causing interruption in the thermal boundary layer proximate the walls, the cooling flow separates from and reattaches to the walls, increasing the convective heat transfer between the airfoil walls and the coolant flowing thereby, over that of a smooth wall condition. The size, quantity and orientation of turbulators on the pressure and suction walls with respect to the coolant flow are selected by those having skill in the art to tailor cooling within the constraints imposed by the geometry of the airfoil and the available coolant flow. Examples of turbulated passages in a turbine blade and a casting core for the manufacture thereof are disclosed in related U.S. Pat. Nos. 4,514,144 and 4,627,480 entitled "Angled Turbulence Promoter" granted to Lee on Apr. 30, 1985 and Dec. 9, 1986, respectively, and assigned to the same assignee as the present invention. While the introduction of turbulators generally increases convective cooling of the airfoil, cooling may suffer when blockage of the flow passages becomes excessive, for example due to the number and height of the turbulators.

When further heat transfer augmentation is required to provide acceptable mechanical properties in the airfoil after optimizing turbulator configuration on the airfoil walls, the volumetric flow rate of coolant may be increased and/or the source of the coolant may be changed to provide lower temperature air to the airfoil to increase the cooling thereof. In either case, such a change increases parasitic losses in the engine with a concomitant reduction in engine operating efficiency. In an existing engine design where airfoil cooling has been determined to be marginal or inadequate, the cost of modifying hardware to provide more or lower temperature cooling flow may be prohibitive. In this instance, blades and vanes could be replaced with components manufactured from a more suitable material, if available, or the existing hardware may be replaced more frequently than would otherwise be required if cooling were adequate.

SUMMARY OF THE INVENTION

An improved internally cooled airfoil for a gas turbine engine comprises pressure and suction side walls joined at respective leading and trailing edges to form a cooling passage therebetween. At least one partition disposed in the cooling passage and connected to both side walls channels the cooling flow therethrough in an advantageous manner. Turbulator ribs disposed on internal surfaces of the pressure and/or suction walls extend into the cooling passage to enhance convective heat transfer between the hot airfoil walls and the coolant flowing therebetween. Additionally, separate turbulator ribs disposed on the partition in a predetermined manner extend into the cooling passage to further enhance the convective heat transfer between the coolant and the hot airfoil walls.

In order to augment convective heat transfer along a portion of a pressure wall having a wall rib disposed thereon, a partition rib extends along a partition from a suction wall to a point spaced from the pressure wall rib. The flow of coolant through the gap formed between the end of the partition rib and the wall rib causes local acceleration of the cooling flow, thereby increasing the convective heat transfer along the pressure wall. Enhanced cooling along a portion of a suction wall may similarly be afforded by providing a partition rib extending from the pressure wall to a point proximate a suction wall rib. Beyond enhancing convective heat transfer of pressure and suction wall ribs, convective heat transfer between the partition rib and coolant flowing thereby affords enhanced conductive heat transfer between the hot walls and the partition as well.

Partition ribs may be configured similarly to wall ribs, having substantially equivalent heights, widths and spacing. Further, partition ribs may be selectively located to provide enhanced heat transfer on only those portions of an airfoil where conventional wall rib convective heat transfer enhancement is marginal or insufficient. This invention is particularly well suited for use in airfoils which include high blockage wall turbulators.

BRIEF DESCRIPTION OF DRAWINGS

The novel features believed characteristic of the invention are set forth and differentiated in the appended claims. The invention, in accordance with preferred and exemplary embodiments, together with further advantages thereof, is more particularly described in the following detailed description taken in conjunction with the accompanying drawings in which:

MODE(S) FOR CARRYING OUT THE INVENTION

Figure 1:
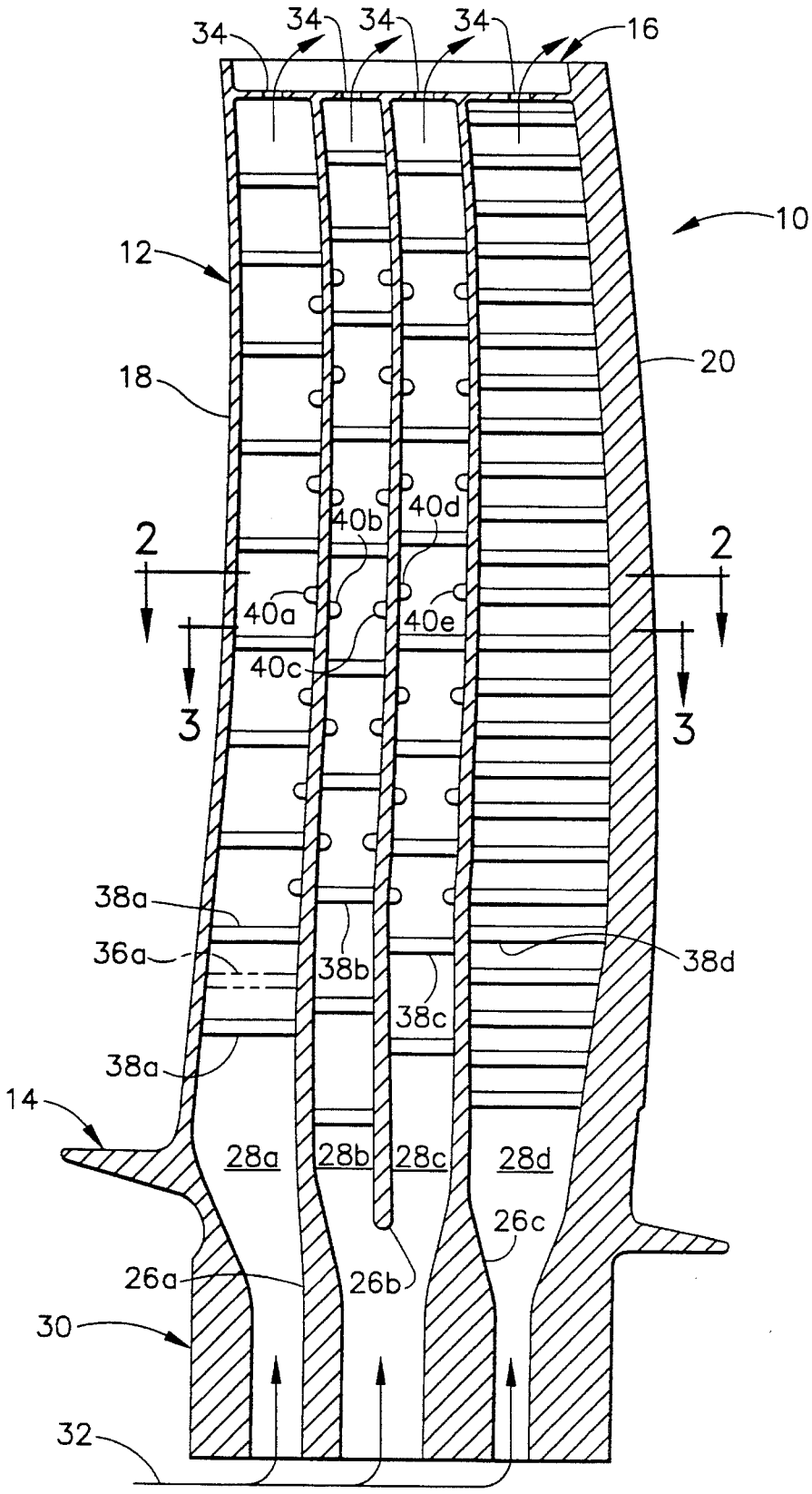
FIG. 1 is a schematic, spanwise sectional view of a turbine blade airfoil in accordance with a preferred embodiment of the present invention.
Figure 2:
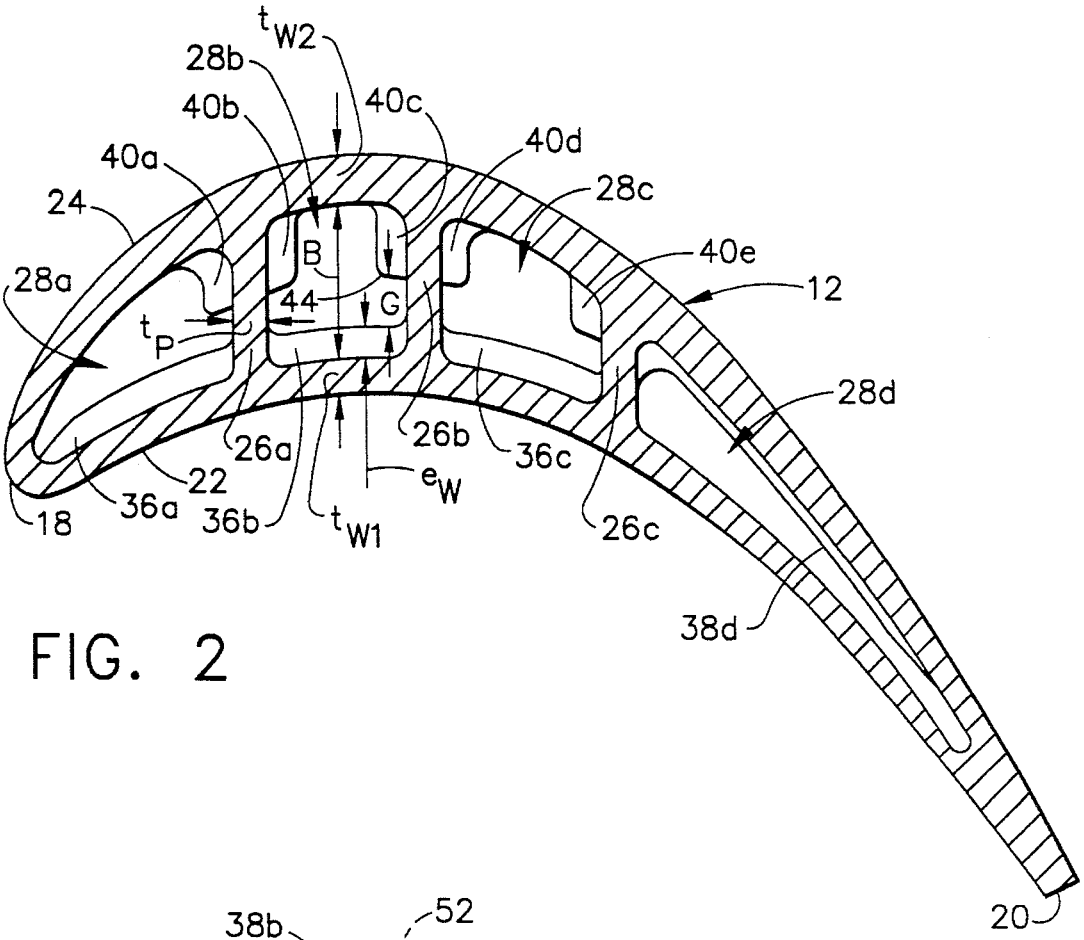
FIG. 2 is an enlarged schematic, chordal sectional view of the airfoil of FIG. 1 taken along line 2—2 thereof.

FIG. 1 is a schematic, sectional view of an airfoil 12 of a turbine blade 10 of a gas turbine engine in accordance with a preferred embodiment of the present invention. As stated above, the teachings of this invention are applicable to any internally cooled airfoil or structure having a flow passage and turbulator ribs, such as nozzle vanes. Airfoil 12 extends in a spanwise direction from blade platform 14 to blade tip 16 and in a chordwise direction from leading edge 18 to trailing edge 20. As best seen in FIG. 2, airfoil 12 is comprised of a concave, pressure side wall 22 and a convex, suction side wall 24. Pressure and suction walls 22, 24 are joined at the leading and trailing edges 18, 20. Referring again to FIG. 1, a plurality of partitions 26*a–c* are disposed between walls 22, 24 and extend generally from a blade root 30 to the tip 16, subdividing the interior of the airfoil 12 into a plurality of cooling flow passages or cavities 28*a–d*. Cooling air 32 enters passages 28*a–d* at the blade root 30 and travels in a spanwise direction, being exhausted through apertures 34 in the tip 16 and/or through leading edge, trailing edge or wall apertures (not shown) in the airfoil 12.

While the cooling configuration depicted in FIG. 1 is commonly referred to as a four pass radial design, the inventive concepts disclosed herein are applicable to a wide variety of conventional cooling configurations including multiple pass radial, serpentine and combinations thereof.

Figure 3:
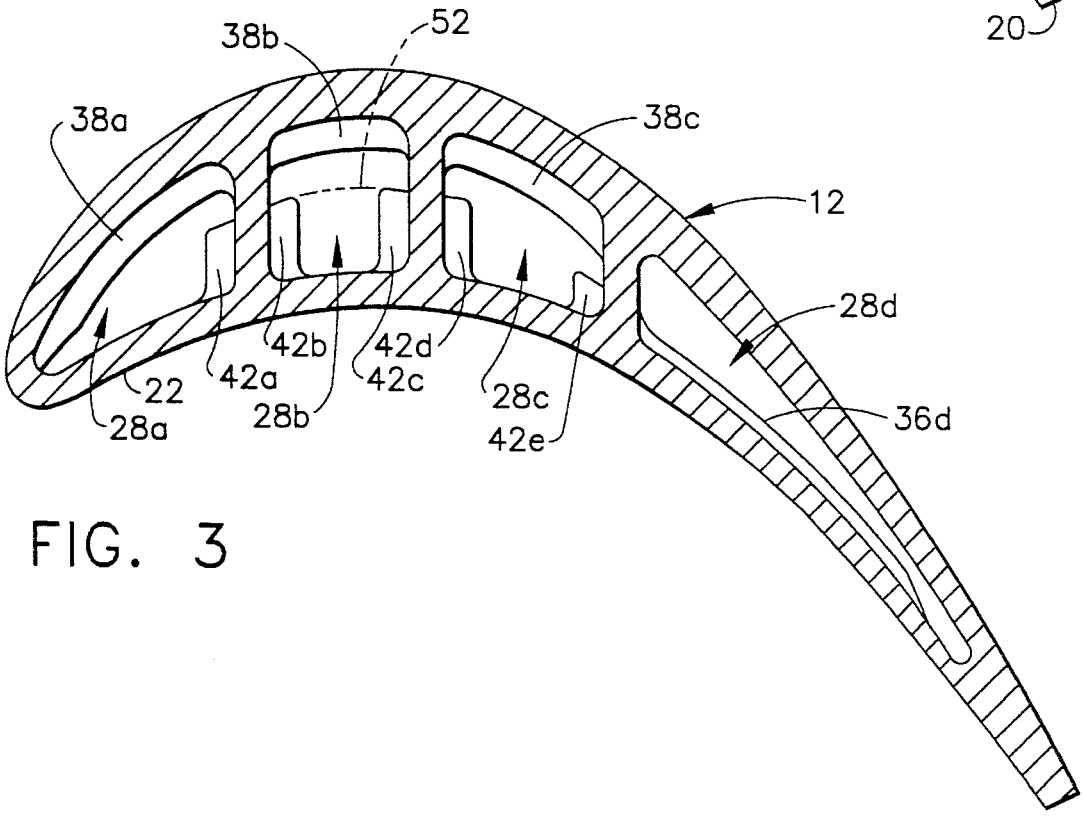
FIG. 3 is an enlarged schematic, chordal sectional view of the airfoil of FIG. 1 taken along line 3—3 thereof.

Leading edge flow passage 28*a* is bounded by walls 22, 24 joined at leading edge 18 and partition 26*a;* midchord flow passage 28*b* is bounded by walls 22, 24 and partitions 26*a, 26b;* midchord flow passage 28*c* is bounded by walls 22, 24 and partitions 26*b, 26c;* and trailing edge flow passage 28*d* is bounded by walls 22, 24 joined at trailing edge 20 and partition 26*c*. Extending into respective flow passages 28*a–d* are a plurality of pressure wall turbulator ribs 36*a–d* and suction wall turbulator ribs 38*a–d* as shown in FIGS. 2 and 3. In this example, placement of pressure and suction wall ribs 36, 38 generally alternates in the spanwise direction. For example, as cooling air 32 flows from root 30 to tip 16 in leading edge passage 28*a* as shown in FIG. 1, the air 32 will alternately flow past a first suction wall rib 38*a,* a pressure side rib 36*a* (shown in phantom), a next suction wall rib 38*a,* a next pressure side rib 36*a* (not shown), etc. Wall ribs 36, 38 are generally shown disposed in a chordwise direction, substantially normal to the direction of flow of coolant 32, as well as uniformly sized and spaced. As will become apparent, the teachings of this invention are applicable to a wide variety of wall turbulator configurations including those having nonuniform size and spacing, as well as those disposed at an acute angle to the direction of coolant flow.

In addition to pressure wall ribs 36*a–c,* a plurality of partition turbulator ribs 40*a–e* extend into flow passages 28*a–c,* as shown in FIG. 2. In this particular embodiment depicted, the partition ribs 40 are substantially coplanar with the wall rib 36 disposed in the same cavity 28 for each chordal section of interest, although the partition ribs 40 could be offset in the spanwise direction as will be discussed in greater detail below. Similarly, a plurality of partition turbulator ribs 42*a–e* extend into flow passages 28*a–c,* substantially coplanar with respective suction wall ribs 38, as shown in FIG. 3. Partition ribs 40 extend from respective partitions 26 into the cavity 28 and from suction wall 24 to a point spaced from pressure wall ribs 36. Partition ribs 42 extend from respective partitions 26 into the cavity 28 and from pressure wall 22 to a point spaced from suction wall ribs 38.

Figure 4:
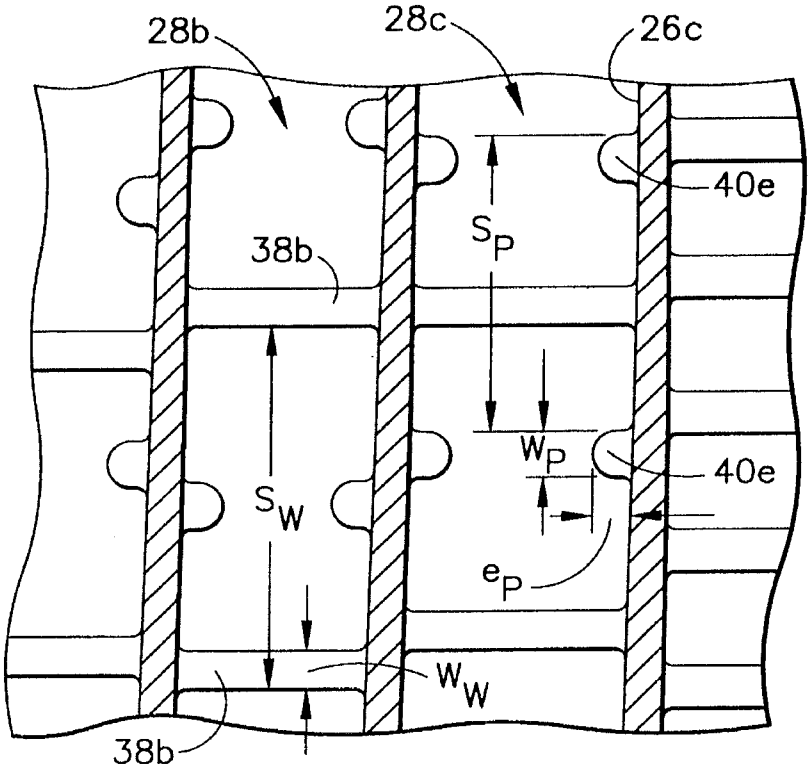
FIG. 4 is an enlarged schematic view of a portion of the airfoil of FIG. 1.

Referring now to FIG. 4, typical partition rib 40*e* has a height, $e_p$, measured from partition 26*c* in a chordal direction into flow passage 28*c,* and a width, $w_p$, measured across the rib 40*e* in a spanwise direction. Spacing, $S_p$, between partition ribs 40*e* is measured in the spanwise direction between like portions of adjacent ribs 40*e* as shown. Wall ribs 36, 38 have similar geometric designations. For example, typical wall rib 38*b* has a width, $w_w$, and spacing, $S_w$, as shown in FIG. 4 and a height, $e_w$, as shown in FIG. 2. Further, flow passage 28*b* has a cavity height, B, measured between internal surfaces of pressure and suction walls 22, 24, also shown in FIG. 2. Pressure wall 22 has local wall thickness, $t_{w1}$, suction wall 24 has local wall thickness, $t_{w2}$, and typical partition 26*a* has wall thickness $t_p$. Finally, a gap, G, is measured between an exposed end face 44 of a typical partition rib 40*c* and a crest of typical proximate wall rib 36*b*.

Figure 5:
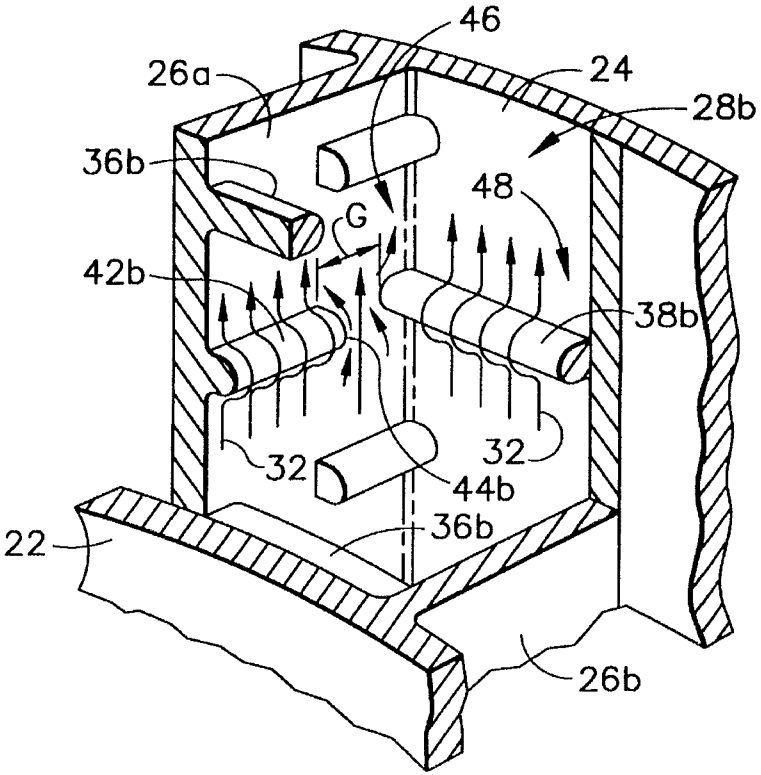
FIG. 5 is a perspective schematic view of a flow passage of the airfoil of FIG. 1.

FIG. 5 is a perspective schematic view of a typical flow passage 28*b* bounded by walls 22, 24 and partitions 26*a, 26b* in accordance with an exemplary embodiment of the instant invention. Conventional wall rib 38*b,* disposed on suction wall 24, extends completely across flow passage 28*b* in a chordal direction, abutting both partition 26*a* and partition 26*b*. Cooling air 32 travelling along wall 24 in a generally spanwise direction, upwardly in the depiction in FIG. 5, encounters rib 38*b* and is forced to separate from wall 24, accelerate around the obstruction created thereby, and reattach to wall 24 upstream of rib 38*b*. Placement of wall rib 38*b* in this manner expectedly enhances convective heat transfer between the cooling flow 32 and suction wall 24 locally. Empirical results indicate that placement of wall rib 38*b* in the manner depicted also locally enhances convective heat transfer along partitions 26*a, 26b* proximate the wall rib 38*b,* due in part to the disruption of the boundary layer, for example in shared corner zone 46 between partition 26*a* and suction wall 24.

Placement of partition rib 42*b* on partition 26*a* proximate wall rib 38*b* in the manner depicted, abutting pressure wall 22 and spaced from wall rib 38*b,* has been shown empirically to unexpectedly enhance convective heat transfer on the suction wall 24. The heat transfer enhancement mechanism is considered to be twofold. First, the placement of rib 42*b* on partition 26*a* enhances the convective heat transfer locally between partition 26*a* and coolant 32 flowing thereby, due to the separation and reattachment of flow as previously described with respect to wall rib 38*b*. Conduction of thermal energy from walls 22, 24, exposed to hot gases over external portions thereof, to partition 26*a* occurs as a result. Further, by leaving a gap G of predetermined dimension between exposed end face 44*b* of partition rib 42*b* and wall rib 38*b,* boundary layer flows along both wall 24 and partition 26*a* in corner zone 46 accelerate through the gap, scrubbing the partition wall 26*a* and further enhancing the convective heat transfer therefrom locally and in the corner zone 46 generally. As can be appreciated by those having skill in the art, similar heat transfer enhancement mechanisms are occurring simultaneously in comer zone 48, having partition rib 42*c* extending from partition 26*b* and spaced from wall rib 38*b* disposed on suction wall 24.

Interestingly and unexpectedly, placement of a turbulator rib 42*b* on a partition 26*a* such that the rib 42*b* abuts pressure wall 22 and is spaced from suction wall 24 and a rib 38*b* disposed thereon enhances heat transfer on the suction wall 24. In a preferred embodiment, the geometry of the partition rib 42*b* is substantially equivalent to the geometry of the proximate wall rib 38*b*. That is to say, ribs 38*b*, 42*b* have substantially equivalent respective heights $e_w$, $e_p$, widths $w_w$, $w_p$, and spacing $S_w$, $S_p$. Further, the gap, G, between end face 44*b* and wall rib 38*b* may be selected to have a value of about $e_w$, the height of wall rib 38*b*. If gap G is too large, the interaction of wall and partition boundary layers in the corner zone 46 is reduced with a concomitant reduction in the convective heat transfer enhancement otherwise attainable. Similarly, if gap G is too small or nonexistent, that is to say if wall rib 38*b* continued through comer zone 46, extending in an uninterrupted manner along both suction wall 24 and partition 26*a*, a cooling flow stagnation zone would be created upstream thereof. Such stagnation zones are characterized by poor convective heat transfer characteristics.

Beyond relative sizing and placement of wall and partition ribs 38*b*, 42*b*, the size of the flow passage 28*b* has been shown to affect the enhancement afforded by partition ribs 42*b*. For example, the convective heat transfer enhancement along suction wall 24 in flow cavity 28*b* having turbulator ribs 42*b* abutting pressure wall 22 and spaced from suction wall 24 is particularly beneficial when cavity 28*b* exhibits high blockage. Blockage is defined as the ratio of wall turbulator height to cavity height or $e_w/B$. A high blockage cavity may be considered to be a cavity or flow passage 28 having a blockage ratio of greater than about 0.10 or 10%. In other words, cavity height, B, is less than about $10e_w$.

Figure 6A:
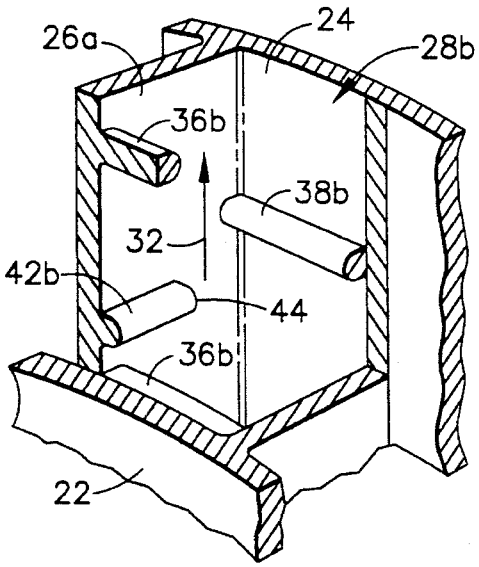
FIGS. 6A–6D are perspective schematic views of flow passages according to various alternate embodiment of the invention.
Figure 6B:
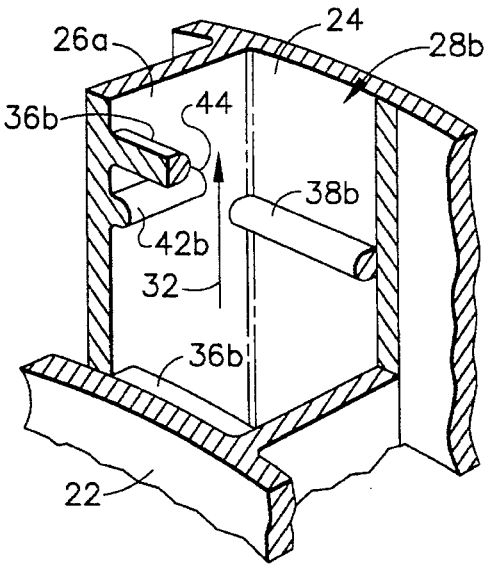

While the discussion to this point has mainly dealt with coplanar wall and turbulator ribs 38*b*, 42*b* disposed substantially normal to the direction of coolant flow, as best seen in FIG. 5, the teachings of the instant invention apply to a broad variety of turbulator configurations. For example, the location of a partition rib 42*b* may vary in the spanwise direction, being offset relative to suction wall rib 38*b* within any geometric limits imposed by any local pressure wall ribs 36*b*. Instead of being coplanar with wall rib 38*b*, partition rib 42*b* may be offset upstream or downstream thereof, as shown respectively in FIGS. 6A and 6B, although the convective heat transfer enhancement has been shown empirically to be attenuated somewhat. Nonetheless, empirical testing has shown the convective heat transfer enhancement to be relatively insensitive to variation in the spanwise placement or registration of the partition rib 42*b* relative to the cooperating wall rib 38*b*. Note that the partition rib 42*b* continues to abut pressure wall 22 and terminates at a point short of suction wall 24. The distance between partition rib end face 44 and suction wall 24 should be at least equivalent to the height, $e_w$, of the proximate suction wall rib 38*b*.

Figure 6C:
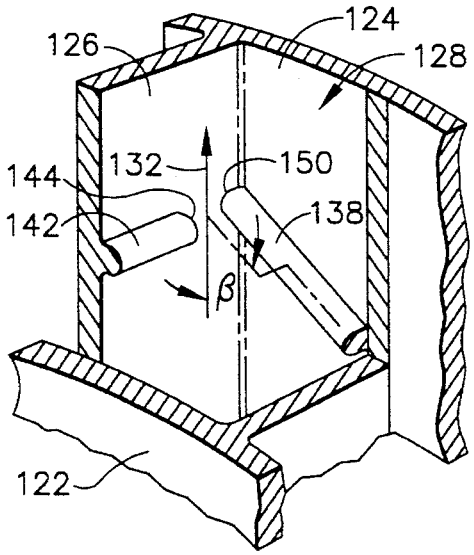

In another embodiment depicted in FIG. 6C, a partition rib 142 disposed substantially normal to the flow of coolant 132 in cavity 128 extends along partition 126 from pressure wall 122 to a point short of suction wall 124 and wall rib 138 disposed thereon. Wall rib 138 is angled in cavity 128 relative to the flow of coolant 132 at a predetermined angle β, as is conventionally known, to direct coolant 132 toward partition 126, although rib 138 could also be angled in an opposite manner to direct coolant away from partition 126. Partition rib 142 may be offset in the spanwise direction as discussed above so that end face 144 is disposed upstream of or downstream from the proximal end 150 of wall rib 138 which abuts partition 126.

Figure 6D:
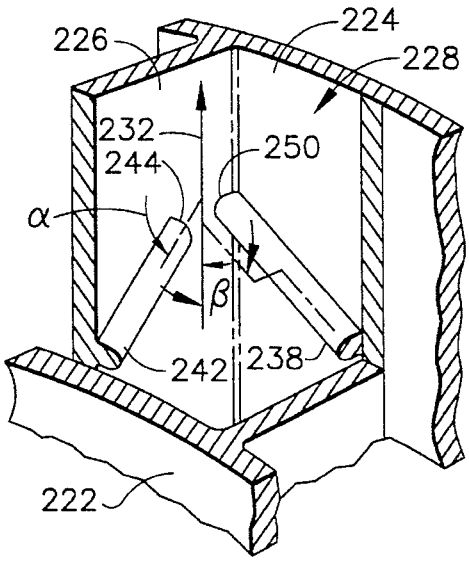

In yet another embodiment depicted in FIG. 6D, a partition rib 242 disposed at a predetermined angle α to the flow of coolant 232 in cavity 228 extends along partition 226 from pressure wall 222 to a point short of suction wall 224 and wall rib 238 disposed thereon. Wall rib 238 is also angled in cavity 228 relative to the flow of coolant 232 at predetermined angle β. Partition rib 242 may be offset in the spanwise direction as discussed above so that end face 244 is disposed upstream of or downstream from the proximal end 250 of wall rib 238 which abuts partition 226. Again, minimum spacing is maintained between end face 244 and either rib 238 or wall 224. Further, one or both of ribs 238, 242 may be angled in the opposite direction relative to flow 232, as desired. Alternatively, partition rib 242 may be angled in either direction relative to flow 232 and wall rib 238 may be disposed normal to the flow 232.

Conventional airfoil manufacturing techniques may be employed to produce the innovative cooling passage contours disclosed herein. For example, cores used in the manufacture of cast airfoils 12 may be readily modified to incorporate partition turbulator ribs 40, 42 disposed normal to flow 32. By modifying a core mold, cores and ultimately airfoils 12 incorporating the ribs 40, 42 may be readily produced in large numbers. For a design incorporating partition ribs 242 disposed at an angle α to coolant flow 232, such as that depicted in FIG. 6D, individual cores otherwise producing smooth partition walls 26 may be modified to incorporate the angled ribs 242. While cores producing angled partition ribs 242 could not be manufactured easily by a conventional core mold, as the rib angle α would prevent separation of the mold halves, a special mold incorporating multiple mold members could be used to produce the desired configuration. Alternatively, blades produced from separately machined blades halves which are subsequently bonded together may readily incorporate the improvements disclosed herein.

For those blades conventionally manufactured by casting, limitations inherent in the casting process may be relevant to practicing the instant invention. For example, to facilitate manufacture, a partition rib end face 44 may be designed to advantageously coincide with a core mold parting line, the location of a portion of which is represented by dotted line 52 in FIG. 3. By terminating a typical partition rib 42 at the parting line, mismatch between a first portion of rib 42 disposed in a first mold half and a second portion of rib 42 disposed in a mating mold half is altogether avoided. In general, however, a small amount of contour mismatch along a length of partition rib 42 will not obviate the beneficial convective heat transfer enhancement afforded over a smooth partition wall. Additionally, depending on the location of the parting line in the final cast airfoil 12, the parting line may be several times the height $e_w$ in distance from a proximate wall turbulator 38 of interest. Depending on the particular configuration, terminating the partition rib 42 at the parting line may leave an excessively large gap G and less than optimal convective heat transfer enhancement.

As with conventional pressure and suction wall ribs 36, 38, designation of partition rib height, $e_p$, width, $w_p$, and overall contour are limited, in part, by the casting process. To ensure complete fill of a typical partition rib 42 during casting, the aspect ratio, which is defined at the ratio of rib height to rib width or $e_p/w_p$, is conventionally valued at about one or less. Further, the cross-sectional contour is generally that of a smoothed mound, as shown for example in FIG. 4, rather than a sharp cornered square or rectangle. The partition rib height, $e_p$, is typically limited to a value equal to or less than about the thickness, $t_p$, of the partition 26 from which the rib 42 extends. This prevents insufficient fill and/or sinking of the opposite side of the partition 26 as the cast material cools. These limitations have generally been imposed by those skilled in the art of casting in order to ensure a high yield of acceptable airfoils 12 in a production environment. Ribs 42 with larger aspect ratios, sharper contours and greater height than partition thickness may be cast, if desired, although special gating or other steps may need to be taken to ensure high yield. In general, since partition ribs 40, 42 have substantially similar geometries to proximate, cooperating wall ribs 36, 38, little or no change to the casting process is required to accommodate the addition of the partition ribs 40, 42.

Since the addition of partition ribs 40, 42 entails a slight increase in airfoil weight, ribs 40, 42 may be designated in an airfoil 12 in solely those areas where additional enhancement is required to minimize airfoil weight. For example, as shown in FIGS. 1–3, partition ribs 40, 42 are located in the leading edge and midchord cavities 28*a–c* and only in central spans thereof. There are no partition ribs 40, 42 located either in trailing edge cavity 28*d* or in the airfoil 12 proximate platform 14 or tip 16. For this particular application, cooling afforded by conventional means in these zones is sufficient. In another application, however, placement of partition ribs 40, 42 in these zones may be highly desirable.

Additionally, airfoils 12 incorporating partition ribs 40, 42 are slightly more resistive to flow therethrough of cooling air 32. Like weight, the impact is nearly negligible and would be problematic in only those airfoils which are serviced by cooling circuits having little or no pressure margin in the first instance. Airfoils operating under these conditions are subject to backflow or ingestion of hot external gases into internal cavities under certain operating conditions. Conventional cooling circuits which are well designed routinely have excess pressure margin in the airfoil cooling portion thereof.

While there have been described herein what are considered to be preferred embodiments of the present invention, other modifications of the invention will be apparent to those skilled in the art from the teaching herein. For example, depending on the requirements of a particular application, the size, location and orientation of partition ribs 40, 42 may vary substantially from those of cooperating pressure or suction wall ribs 22, 24. Further, partition ribs 40, 42 may be used in cooperation with wall ribs 22, 24 having noncontinuous features such as gaps, nonlinear features such as zig-zag steps or internal bends, or other varying features such as taper or curvature. Yet further, partition ribs 40, 42 may be used in cooperation with a wall rib which abuts solely a single partition, such as rib 36*a* disposed in leading edge cavity 28*a* of FIG. 2 which abuts partition 26*a* only. Additionally, with reference to FIG. 2, partition ribs 40, 42 need not be disposed on both sides of every partition nor need they be utilized in pairs within a given cavity 28. Also, for those applications in which convective heat transfer need be enhanced solely along one of a pair of airfoil walls, for example pressure wall 22, solely partition ribs 40 which abut suction wall 24 need be incorporated.

It is therefore desired to be secured in the appended claims all such modifications as fall within the true spirit and scope of the invention. Accordingly, what is desired to be secured by Letters Patent of the United States is the invention as defined and differentiated in the following claims.

We claim:

1. An enhanced cooling apparatus comprising:

a first wall exposed to a first flow on a first side thereof and a second flow on a second side thereof;

a second wall spaced from said second side of said first wall defining a flow passage therebetween through which said second flow passes;

a partition disposed between and connected to both said second wall and said second side of said first wall, having a first side thereof exposed to said second flow flowing in said flow passage;

at least one wall turbulator rib disposed solely on said second side of said first wall, extending into said flow passage and having a proximal end abutting said partition; and at least one partition turbulator rib disposed solely on said first side of said partition, extending into said flow passage, having a first end spaced from said wall rib and said second side of said first wall, and having a second end abutting said second wall.

2. The invention according to claim 1 wherein:

said partition rib first end is substantially aligned with said proximal end of said wall rib in a direction normal to a primary flow direction of said second flow in said flow passage.

3. The invention according to claim 2 wherein:

said partition rib is substantially coplanar with said wall rib.

4. The invention according to claim 1 wherein:

said partition rib first end is offset from said proximal end of said wall rib in a direction along a primary flow direction of said second flow in said flow passage.

5. The invention according to claim 1 wherein:

said wall rib has a height value, $e_w$, and a width value, $w_w$;

said partition rib has a height value, $e_p$, and a width value, $w_p$; and a distance between said partition rib first end and said wall rib is at least equal to $e_w$.

6. The invention according to claim 5 wherein:

a distance between said partition rib first end and said second side of said first wall is at least equal to $e_w$.

7. The invention according to claim 5 wherein:

$e_p$ is substantially equal to $e_w$; and $w_p$ is substantially equal to $w_w$.

8. The invention according to claim 5 wherein:

a height of said flow passage between said first wall and said second wall is less than or equal to about $10e_w$.

9. The invention according to claim 1 wherein:

at least one of said wall rib and said partition rib is angled with respect to a primary direction of flow of said second flow through said flow passage.

10. An internally cooled airfoil for a gas turbine engine comprising:

a pressure wall and a suction wall attached at respective leading edges and trailing edges thereof forming a cooling passage therebetween;

a first partition disposed in said cooling passage and connected to both said pressure and suction walls along internal surfaces thereof;

at least one wall turbulator rib disposed solely on one of said internal surfaces of said pressure wall and said suction wall, said wall turbulator rib extending into said cooling passage and having a proximal end abutting said first partition; and at least one partition turbulator rib disposed solely on said first partition, extending into said cooling passage, having a first end spaced from said wall rib and said one of said pressure wall and said suction wall from which said wall rib extends, and having a second end abutting the other of said pressure wall and said suction wall from which said wall rib does not extend.

11. The invention according to claim 10 further comprising:

a second partition disposed in said cooling passage and connected to both said pressure and suction walls along internal surfaces thereof; and at least one partition turbulator rib disposed solely on said second partition, extending into said cooling passage, having a first end spaced from said wall rib and said one of said pressure wall and said suction wall from which said wall rib extends, and having a second end abutting the other one of said pressure wall and said suction wall from which said wall rib does not extend.

12. The invention according to claim 11 wherein:

a distal end of said wall rib abuts said second partition.

13. The invention according to claim 11 wherein:

said wall rib has a height value, $e_w$, and a width value, $w_w$;

said first partition rib has a height value, $e_{p1}$, and a width value, $w_{p1}$;

said second partition rib has a height value, $e_{p2}$, and a width value, $w_{p2}$;

a distance between said first partition rib first end and said wall rib is at least equal to about $e_w$; and a distance between said second partition rib first end and said wall rib is at least equal to about $e_w$.

14. The invention according to claim 13 wherein:

a height of said cooling passage between said pressure wall and said suction wall is less than or equal to about $10e_w$.

15. The invention according to claim 13 wherein:

respective local thicknesses of said first partition and said second partition are about equal to or greater than values of $e_{p1}$ and $e_{p2}$ of respective partition ribs disposed thereon.

16. The invention according to claim 13 wherein:

$e_w$, $e_{p1}$ and $e_{p2}$ are substantially equivalent.

17. The invention according to claim 16 wherein:

$w_w$, $w_{p1}$ and $w_{p2}$ are substantially equivalent.

18. The invention according to claim 17 wherein:

$e_w$ is substantially equivalent to $w_w$.

19. The invention according to claim 11 wherein:

at least two wall ribs are disposed alternately on said pressure wall and said suction wall along at least a portion of said cooling passage of said airfoil.

20. The invention according to claim 10 wherein:

said airfoil forms a portion of a turbine blade.

* * * * *